United States Patent [19]

Barrus, Jr.

[11] Patent Number: 4,627,673

[45] Date of Patent: Dec. 9, 1986

[54] GROUNDING AND STRAIN RELIEF CLAMP FOR FLAT CABLES

[75] Inventor: George H. Barrus, Jr., Dracut, Mass.

[73] Assignee: Wang Laboratories, Inc., Lowell, Mass.

[21] Appl. No.: 811,590

[22] Filed: Dec. 20, 1985

[51] Int. Cl.[4] ..... H01R 4/66

[52] U.S. Cl. ..... 339/14 R; 339/17 F; 339/103 M; 339/143 R

[58] Field of Search ..... 339/14 R, 17 F, 103 R, 339/103 M, 92 M, 143 R, 176 MF

[56] References Cited

U.S. PATENT DOCUMENTS 3,059,211 10/1962 Thomas et al. ..... 339/92 M X
4,178,057 12/1979 McCormick ..... 339/103 M
4,422,700 12/1983 Krenz ..... 339/14 R

FOREIGN PATENT DOCUMENTS 922729 4/1963 United Kingdom ..... 339/17 F

*Primary Examiner*—Eugene F. Desmond
*Attorney, Agent, or Firm*—Michael H. Shanahan; Kenneth L. Milik

[57] ABSTRACT

A combined grounding and strain relief clamp for shielded, jacketed flat cables includes an elongated housing having a truncated wedge-shaped cavity with large and narrow apertures for passing a flat electrical cable therethrough. The clamp further includes a pair of metallic wedge plates for insertion into the large aperture of the cavity with a cable passing therebetween. The wedge members are positioned above and below the cable, between the shield and jacket, the housing is fitted over the wedge plates, and the clamp is mounted on a grounding, extending the cable shield through the grounding panel. Forces between the wedge plates and the sloped cavity walls simultaneously ground the cable shield the mounting panel, while providing high degree of clamping force to jacket.

6 Claims, 11 Drawing Figures

GROUNDING AND STRAIN RELIEF CLAMP FOR FLAT CABLES

FIELD

This invention relates generally to devices for terminating multi-conductor, shielded cables used in transferring data and control signals between electronic systems, and more particularly to a cable clamp for shielded, jacketed flat cables which provides superior grounding and strain relief.

BACKGROUND

Flat cables provide a number of advantages wherever there is a need to convey a large number of conductors between electronic equipment and systems. They have a uniform conductor-to-conductor relationship, which makes them easy to use. The physical arrangement of the conductors provides other advantages, such as uniform heat dissipation and compactness.

Structurally, a flat cable is simply a number of insulated conductors or twisted pairs arranged in a parallel, planar configuration and embedded in a layer of plastic. For certain applications, however, such as the interconnection of a disk drive unit and a central processing unit, the flat cable is shielded by enclosing the conductors in a metallic foil layer to provide isolation to external radio frequency or electromagnetic interference. The shielding also prevents RFI/EMI from radiating outward from the cable, an important consideration when having data processing equipment certified under the FCC rules or where data security is important. The metallic foil layer is further surrounded by an insulative jacket, normally of vinyl, which protects the cable from damage and provides strain relief to the internal conductors.

To provide these functions, it is important that the metallic foil layer be grounded to the cabinet of the electronic equipment and that the insulative jacket be fixedly attached to the electronics cabinet to provide strain relief to the cable. Various approaches have been taken to providing a cable clamp or termination assembly that is effective.

U.S. Pat. No. 4,536,053 issued to R. R. Maros, discloses a connector assembly for a shielded, jacketed flat cable, which includes a pair of metallic housing halves to contain the cable. The jacket is stripped back from the end of the cable and the shield is trimmed and folded back on its remaining jacket and positioned in contact with a spring arm or grounding strap mounted in a shallow recess of each housing half. U.S. Pat. No. 4,536,053 also dicusses other termination assemblies for flat cables which may be considered representative.

Another approach to a grounding/strain-relief clamp for flat cables is known, which consists of a pair of spaced, opposing L-shaped grounding plates welded to a flat mounting bracket which, in turn, is bolted to the grounding panel of the electronic device. To use this clamp, the cable jacket is stripped back from the shield, and the shielded cable is passed between the L-shaped plates, through a slot in the bracket, and into an aperture in an grounding panel. A portion of the jacket is positioned between clips on the L-shaped plates, and the plates are bolted together.

This clamp has an important advantage over other types, in that the cable shield is allowed to extend inside the electronics cabinet. In other clamps, the end of the shield remains outside the electronics cabinet or at its entry point, often leaving gaps which partially defeat the function of the foil shield and result in data errors or a compromise of data security. However, this clamp has several disadvantages. Because access to the side of the clamp is required for inserting mounting bolts, an excessive area of the grounding panel is used for each clamp. Furthermore, proper installation of the clamp is somewhat complex, because of the installation of two sets of bolts and jacket retaining clips, and these clamps are often installed incorrectly, again defeating their function.

SUMMARY

The present invention is a cable clamp which provides improved grounding and strain relief, requires a small surface area for mounting, is simple and inexpensive to manufacture, is easy to assemble, and is incapable of being installed incorrectly.

According to the present invention, a combination grounding and strain relief cable clamp is provided for terminating shielded, jacketed flat cables which interconnect two electronic devices, such as a CPU and a disk drive unit. The clamp comprises a housing and a pair of metallic wedge members or wedge plates. The housing is elongated with a cross section that defines a truncated wedge having a narrow end, a wide end, and an a large interior cavity which conforms to the shape of the housing. The housing has a narrow, elongated aperture through the narrow end of the housing and a large opening or aperture through the wide end to accommodate the passage of cable therethrough. The metallic wedge plates are elongated and have generally truncated half-wedge cross sections with dimensions which allow them to be placed together to form a full truncated wedge and then be received into the cavity of the housing along with the cable. Each wedge plate has back and bottom surfaces for grounding the cable shield and a sloped surface for gripping the cable jacket.

To use the clamp, the connector end of the flat cable is inserted through the aperture in the housing, and its vinyl jacket is stripped back a specified length from the shield, and the jacket is further split to form two lips of a specified length. The wedge plates are then inserted above and below the cable, between the foil shield and the vinyl jacket lips, and the housing is fitted over the wedge plates. The assembly is positioned with the bottom surfaces of the wedge plates pressed against the grounding panel of an electronic device and the end of the cable shield extending into an aperture in the gounding panel. Mounting screws are inserted through the housing into the grounding panel and tightened. During tightening, the wedge plates are compressed against the foil shield and against the gounding panel, providing positive grounding of the foil. At the same time, the vinyl jacket lips are compressed and anchored between the sloped sufaces of the wedge plates and the sloped walls of the housing cavity, providing a high degree of clamping force to the end of the jacket.

In another aspect of the invention, each wedge plate includes longitudinal ribs on its sloped surface to provide additional gripping force on the vinyl jacket.

In still another aspect of the present invention, each wedge plate includes support ears, which prevent excessive tightening force from bending or warping the grounding panel and thereby assures a uniform mechanical contact between the bottom surface of each wedge plate and the grounding panel.

By use of the present invention the cable shield may be extended inside the electronics cabinet, thereby providing improved EMI/RFI shielding.

Accordingly, a primary object of the present invention is to provide a novel and improved cable clamp for providing improved grounding and strain relief.

Another object of the present invention is to provide a cable clamp which is simple in structure and inexpensive to manufacture.

A further object of the present invention is to provide a cable clamp which requires a small amount of surface area on a grounding panel for its installation, and can be installed close to similar clamps.

Another object of the present invention is to provide a grounding/strain-relief cable clamp which is easy to install, while providing a high degree of clamping force.

It is still another object to provide a cable clamp which cannot be installed incorrectly.

BRIEF DESCRIPTION OF THE DRAWINGS

The foregoing and other objects, features and advantages of the invention will be apparent from the following more particular description of a preferred embodiment of the invention, in conjunction with the accompanying drawings. In the drawings.

DESCRIPTION OF THE PREFERRED EMBODIMENT

Figure 1:
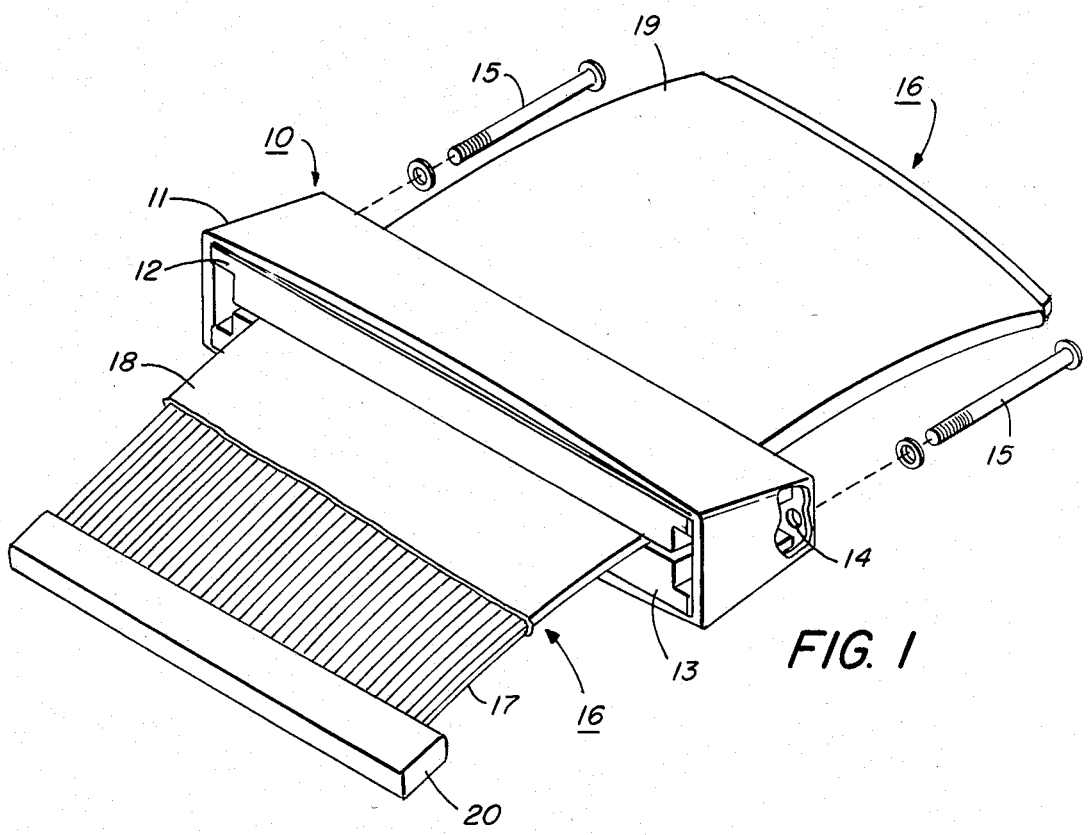
FIG. 1 is a perspective view of the cable clamp of the present invention, showing its proper installation on a shielded, jacketed flat cable.

FIG. 1 illustrates a preferred embodiment of a flat cable clamp assembly, generally designated as 10, which provides improved grounding and strain relief. As more clearly shown in FIG. 3, the major components of the clamp assembly 10, hereinafter referred to as the clamp, are a housing 11 and a pair of wedge plates 12 and 13. In the preferred embodiment, the clamp 10 is installed on the rear grounding panel of a central processing unit and an identical clamp 10 is mounted on the grounding panel of a disk drive unit. To provide for this mounting, the housing 11 is provided with apertures 14 (one of two is shown in FIG. 1) at each end for receiving mounting screws 15.

The cable 16 is a shielded, jacketed flat cable, for carrying data and control signals between a CPU and disk drive unit, and is terminated at its respective ends by means of the clamp 10. In FIG. 1, the cable 16 is shown extending through the cable clamp housing 11 in a manner that will be described in what follows.

Figure 2:
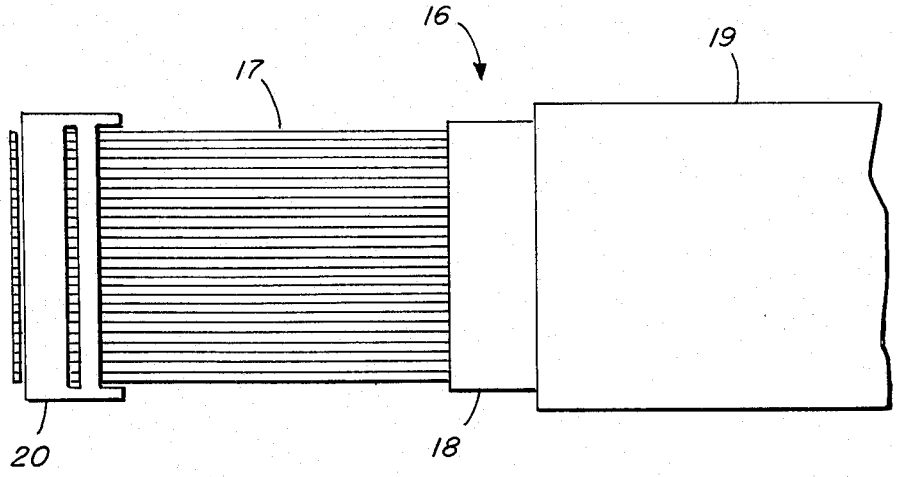
FIG. 2 is an illustration of a shielded, jacketed flat cable, as used with the present invention, showing its component parts.

A cable of the type used with the present invention is illustrated in FIG. 2. The flat cable 16 includes a number of spaced conductors 17 arranged in a parallel, planar configuration, forming the core of the cable. In the preferred embodiment, the flat cable employs either 26 or 60 separate conductors. The conductors are embedded in or laminated to a layer of insulative plastic (not shown) to bind them together in this configuration. Alternatively, the cable employs twisted pairs of conductive wires, each having its own separate insulative wrap or jacket in the place of individual conductors. A metallic shield 18, composed of conductive foil, or foil with a backing of Mylar, surrounds the conductors 17 for EMI/RFI shielding purposes. To be effective as a shield, this foil layer is grounded at each end to the metal cabinet of the electronic device; that is, to the CPU at one end and to the disk drive at the other end. The cable further comprises an outer sheath or jacket 19 composed of flexible, insulative material, typically vinyl. The jacket 19 provides strain relief to the cable, and to be effective, it must be secured to the cabinet of the two electronic devices with sufficient clamping force to resist a direct pull of some magnitude, typically 25 pounds minimum.

The spaced conductors 17 terminate in a connector 20. The connector 20 is a flat cable connector, such as a standard insulation-displacement contact (IDC) connector, although it is understood that other connector types may be used. The connector itself is not shielded. The connector 20 is inserted into a mating receptacle or socket located on a printed circuit board within the cabinet of the electronic device.

Figure 3:
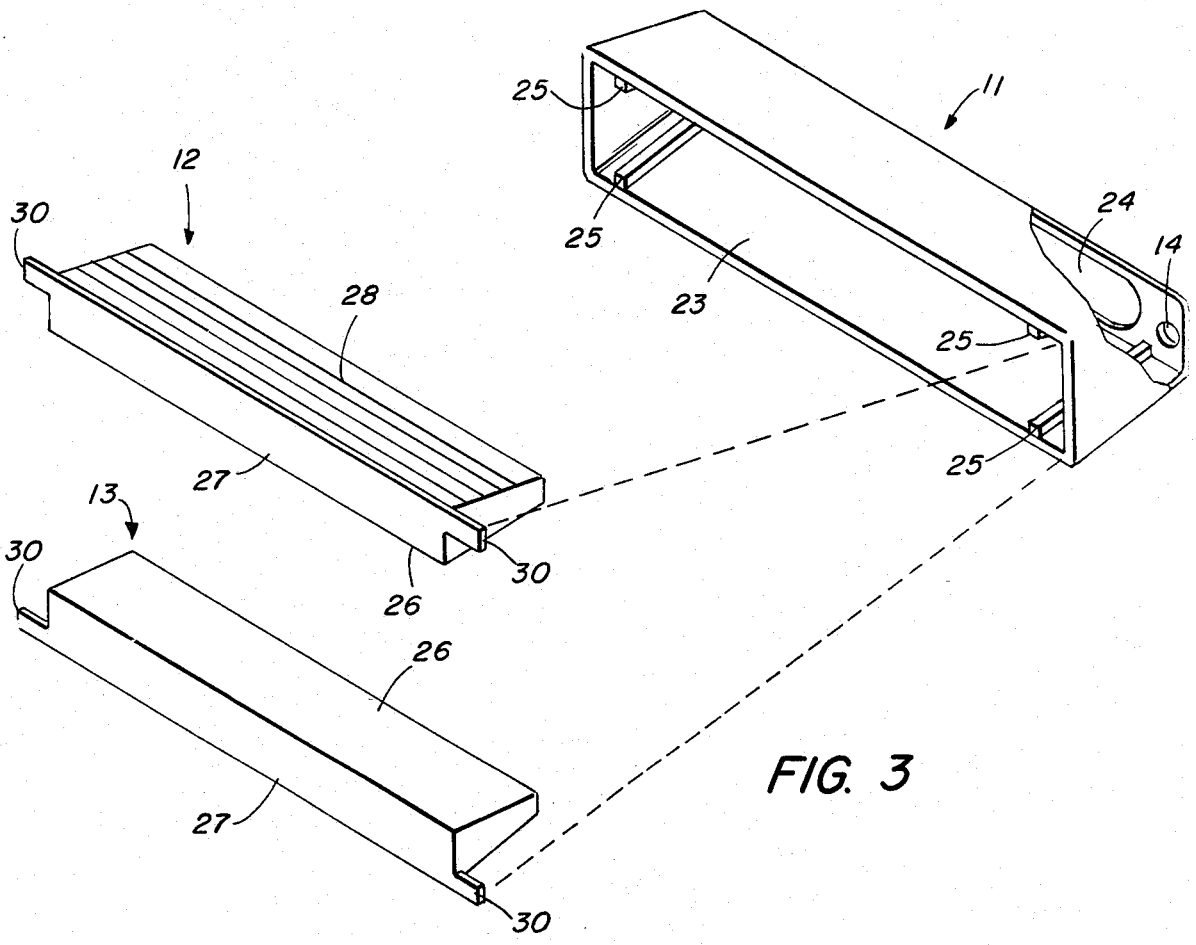
FIG. 3 is a exploded view of the cable clamp of the present invention.
Figure 4:
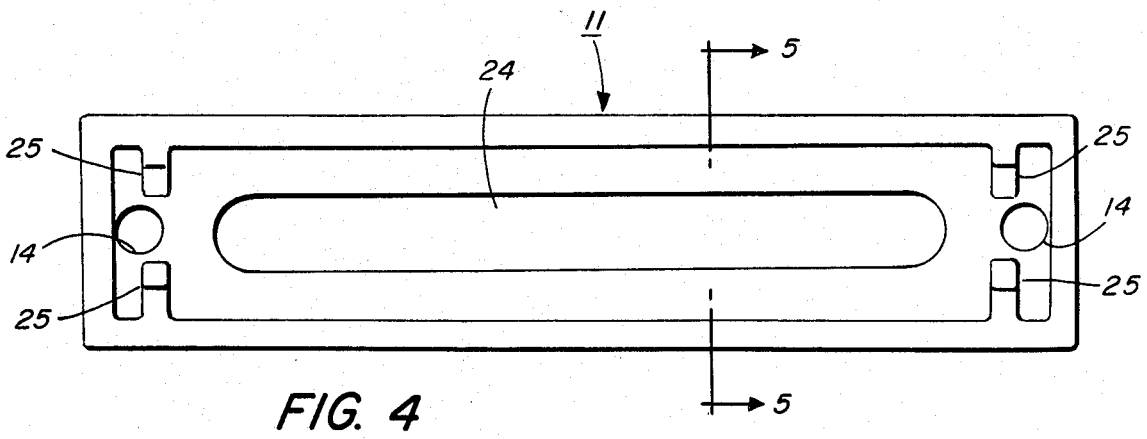
FIG. 4 illustrates the structure of the housing, as viewed from its wide end, showing the open cavity.
Figure 5:
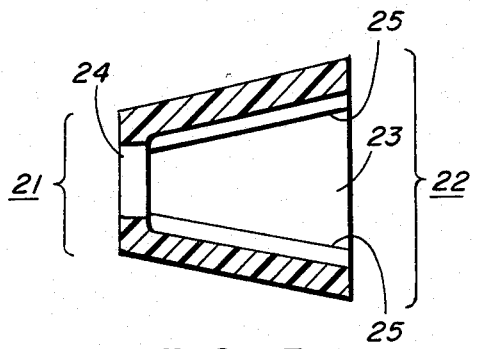
FIG. 5 is a sectional view of the housing of the present invention, taken along the line 5—5 on FIG. 4.

The housing 11 is illustrated in more detail in FIGS. 3 through 5. The housing 11 is single-piece ridged structure, molded from an electrical insulating material such as polycarbonate. The housing 11 is elongated with a cross section (shown in FIG. 5) that defines a truncated wedge having a narrow end 21, a wide end 22. An interior cavity 23 conforms to the shape of housing 11.

The housing 11 has a narrow, elongated aperture 24 through the narrow end 21 of housing 11 and a large opening or aperture through wide end 22 to accommodate the passage of cable therethrough. Elongated aperture 24 has dimensions slightly greater than those of the largest shielded, jacketed flat cable to be accommodated by the clamp, which is 60 conductors. Cables having smaller dimensions may be effectively used with no required changes to the clamp. The large opening on wide end 22 of the housing is used with the wedge plates 12 and 13 as will be explained below.

Figure 11:
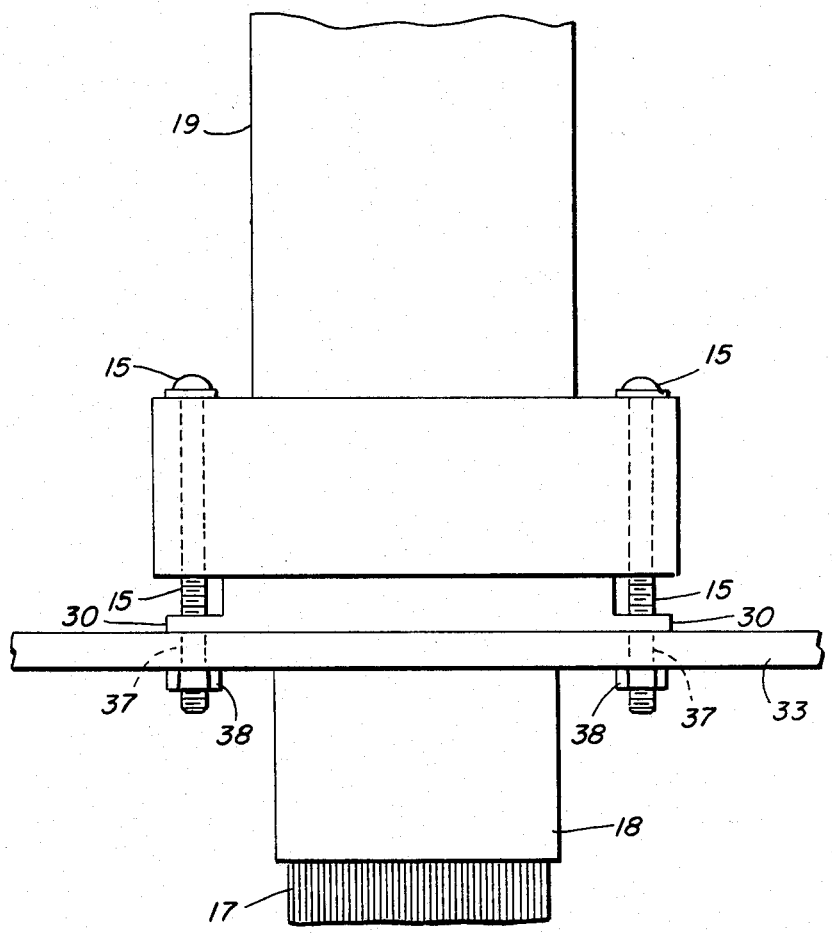
FIG. 11 is a side view of the clamp assembly, installed on a grounding panel, showing particularly the relationship between housing, mounting screws, and wedge plates.

On the narrow end 21 are screw holes or apertures 14, located on each side of aperture 24, for receiving the mounting screws 15 (which are shown in FIG. 1 and 11). The housing 11 is mounted with its wide end 22 toward a grounding panel of an electronics cabinet or electronics chassis. The mounting screws 15 pass through the cavity 23 and exit the large opening in the wide end 22, where they are inserted into the grounding panel of the electronics device. This relationship is shown most clearly in FIG. 11.

Two pairs of molded ribs 25 run along the interior sloped walls of the cavity 23, one pair on an upper wall and one pair on a lower wall, between the elongated aperture 24 and the smaller apertures 14. The ribs 25 in each pair are spaced apart a distance slightly greater than the width of a wedge plate 12 and 13 and provide a guide for inserting the wedge plates into the housing 11. Upon assembly of the clamp, the ribs 25 horizontally align the wedge plates 12 and 13 within housing 11 such that the wedge plates are between the molded ribs 25 and not obstructing apertures 14 for the mounting screws 15.

Figure 6:
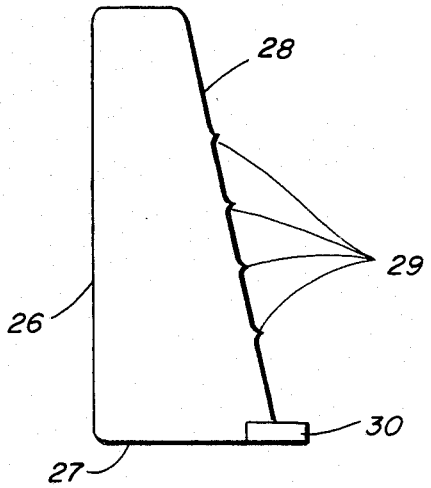
FIG. 6 is a side view of a wedge plate of the present invention.
Figure 7:
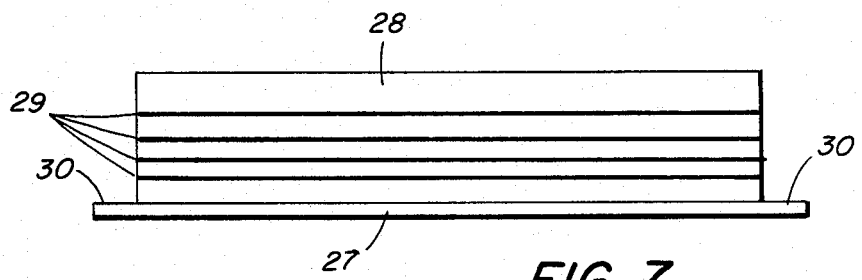
FIG. 7 is a front view of a wedge plate of the present invention.

Referring now to FIG. 3 and FIGS. 6 through 8, the structure of a wedge plate is shown in some detail. The wedge plates 12 and 13 are of a one-piece metallic construction, and in the preferred embodiment, the wedge plates are composed of extruded aluminum. Both wedge plates 12 and 13 are identical in shape and dimensions. FIG. 7 shows a side view of a wedge plate, illustrating that the wedge plate has a cross section that is generally a truncated half-wedge. The wedge plates 12 and 13 each have a back surface 26, a bottom surface 27, and an sloped surface 28. The back surface 26 and bottom surface 27 are joined together in an L-shape to form a grounding surface, which contacts cable shield 18 and the grounding panel of the electronic device. Sloped surface 28 is for gripping the vinyl cable jacket 19 (FIG. 2).

When the wedge plates 12 and 13 are positioned with their back surfaces 26 facing (FIG. 3), the wedge plates 12 and 13 have a cross section which defines a truncated wedge, conforming to the shape of cavity 23, with physical dimensions which are slightly less than cavity 23. The difference in physical dimensions allows the wedge plates 12 and 13 to be received into housing cavity 23 with the flat cable 16 passing between them.

Referring to FIGS. 6 and 7, longitudinal ribs 29 extend lengthwise along the sloped surface 28 of each wedge plate 12 and 13 and project outwardly therefrom. During installation of the clamp, the jacket 19 of the cable 16 is compressed and anchored between the sloped surface 28 of the wedge plates 12 and 13 and the sloped walls of cavity 23, and longitudinal ribs 29 press into vinyl jacket 19 of cable 16 to provide additional clamping force between the wedge plates and the vinyl jacket.

Figure 8:
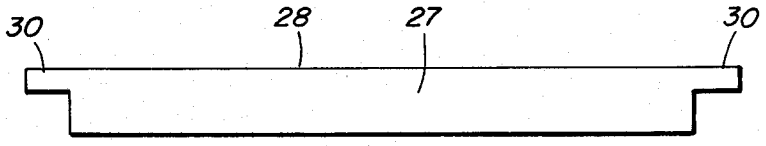
FIG. 8 is a bottom view of a wedge plate of the present invention.

Referring now to FIG. 6 through 8, the wedge plates 12 and 13 are shown to each have a pair of support ears 30 extending longitudinally outward from the bottom surface 27 adjacent to the sloped surface 28, and having a width which is less than that of the bottom surface 27. When the wedge plates 12 and 13 are positioned with their back surfaces 26 facing (FIG. 3), the support ears 30 define a notch at each end of the wedge plates 12 and 13 through which the mounting screws 15 may pass unobstructed. The purpose of the support ears 30 is to prevent excessive tightening force on mounting screws 15 from bending or warping the grounding panel. This assures a uniform mechanical contact between the bottom surface 26 of each wedge plates 12 and 13 and the grounding panel. This is accomplished basically as follows.

When the clamp 10 is properly installed on a grounding panel 33, as illustrated in FIG. 11, the support ears 30 effectively increase the length of bottom surface 27 of each wedge plate beyond the location of the mounting screws 15. As the mounting screws 15 are tightened, an upward force is applied where the mounting screws 15 enter grounding panel 33, tending to bow panel 33 downward under the clamp 10; however, the support ears 30 apply equal downward force at these locations on the grounding panel 33 and prevent the panel 33 from bowing.

Figure 9:
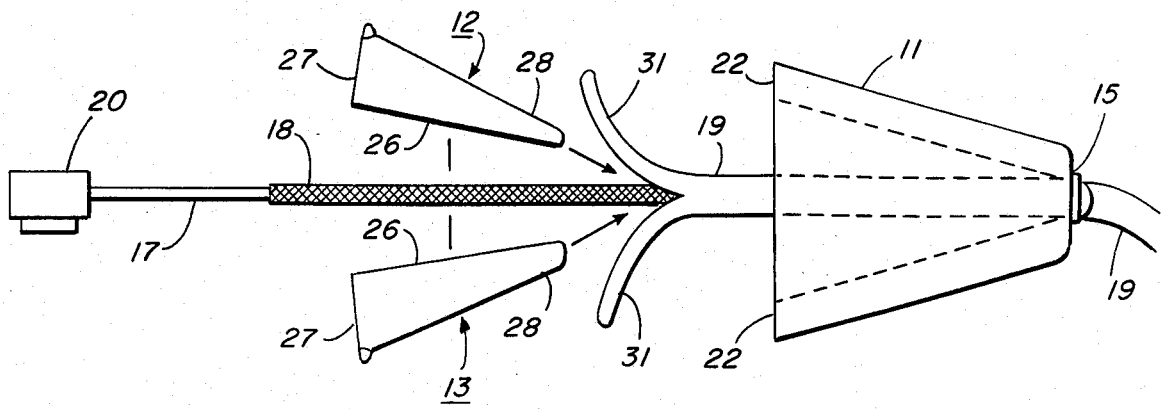
FIG. 9 illustrates the proper method of assembly for the present invention.

Installation and use of the clamp 10 to provide grounding and strain relief will now be described in more detail. The assembly and installation of the clamp 10 is illustrated most clearly in FIG. 9. The housing 11 is placed onto the cable with the wide end 22 of the housing 11 facing toward the connector 20 of the cable. Before terminating the cable, the vinyl jacket 19 is trimmed back a length sufficient to extend the metallic shield 18 inside the grounding panel 33. This length will generally be determined by the desired EMI/RFI shielding requirements and the characteristics of the electronic device itself. In the preferred embodiment, 2.0 inches was found to be adequate. After the vinyl jacket 19 has been stripped back, the remaining jacket 19 is cut or split at its edges to form lips 31, of a length that is determined by the depth of housing 11, to define the clamping surfaces. In the preferred embodiment, this was chosen to be 0.70 inches.

The wedge plates 12 and 13 are positioned above and below the foil-wrapped cable, with bottom surfaces 27 facing toward the connector 20 of the cable and with back surfaces 26 against foil shield 18. The wedge plates 12 and 13 are slid tightly under lips 31 of the jacket 19. Housing 11 is then fitted over wedge plates 12 and 13.

Figure 10:
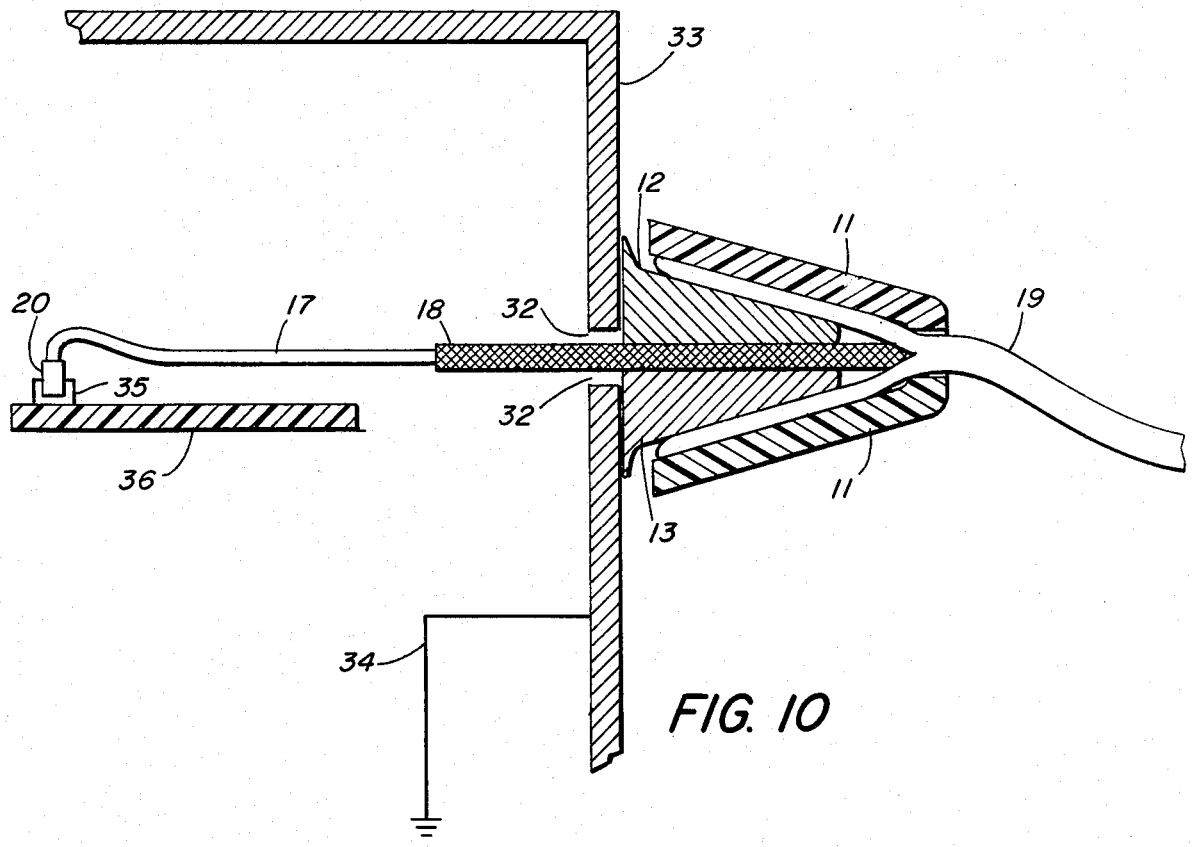
FIG. 10 is a cross sectional view of the completed assembly for the present invention, showing its proper mounting on a grounding panel.

Referring now to FIGS. 10 and 11, there is shown a metallic grounding panel 33 having a precut aperture 32 therein. The grounding panel is electrically connected to a system ground by means of ground wire 34. The precut aperture 32 is rectangular, having the minimum dimensions which will allow passage of the connector therethrough, to ensure the maximum contact area between the wedge plates 12 and 13 and the exterior surface of the grounding panel 33. On the sides on aperture 32, two precut holes 37 are provided for receiving mounting screws 15. In the preferred embodiment, captive nuts 38 were pressed into the holes 37 to engage the mounting screws 15, although separated nuts would also be effective.

The connector 20 on the end of the foil-wrapped cable is next inserted into the precut aperture 32 in the grounding panel 33, with shield 18 extending inside the grounding panel. The connector 20 is then conveniently plugged into a connector receptable 35 on a printed circuit board 36. There is no restriction on the distance the cable extends from the inner wall of the grounding panel 33 to receptacle 35.

Mounting screws 15 are inserted through the apertures 14 and through the precut holes 37 and gradually tightened into place.

As mounting screws 15 are tightened firmly on the housing 11, the back surfaces 26 of the wedge plates 12 and 13 are compressed against the foil shield 18 of the cable 16, while the bottom surfaces 27 are compressed against the grounding panel 33 of the electronics cabinet, providing positive grounding of the foil shield 18. At the same time, lips 31 are compressed between the sloped surfaces 28 of the wedge plates 12 and 13 and the sloped walls of cavity 23, providing the strain relief function. In the preferred embodiment, the clamp 10 provides a clamping force in excess of 100 pounds direct pull on the cable.

Concurrently with the tightening of the mounting screws 15, the longitudinal ribs 29 press into the lips 31 to provide additional clamping force between the wedge plates 12 and 13 vinyl jacket. And finally, also at the same time, the support ears 30 press downwardly on the grounding panel 33, to prevent bowing or warping of grounding panel 33, thereby assuring a uniform mechanical contact between the wedge plates 12 and 13 and the grounding panel 33.

Referring to FIGS. 10 and 11, the clamp 10 is shown properly installed. It will be seen that, although the bottom surfaces 27 of wedge plates 12 and 13 are in firm contact with the grounding panel 33, the housing 11 is not and generally should not be with in contact with the grounding panel 33, due to the thickness of lips 31.

In view of the above, it will be seen that the several objects of the present invention are readily achieved and other advantageous results attained.

Obviously many modifications and variations of the present invention are possible in light of the above teachings, without departing from the spirit and scope of the invention. For example, the principles of the present invention could be used for clamping cables different from those specifically described herein. In the case of unshielded cables, it is possible that the principles disclosed herein could be used to design clamps which provide a single function, either improved strain relief or improved grounding, rather than improved strain relief and improved grounding, as in the preferred embodiment above. In view of this, it is understood that the above description is illustrative rather than limiting.

What is claimed is:

1. A cable clamp for shielded, jacketed flat cables comprising an insulated housing having a truncated wedge-shaped cavity with apertures at its narrow and wide ends for passage of flat electrical cable therethrough;

top and bottom wedge plates for insertion into the wide end of the cavity above and below a cable passing therebetween; and means for mounting the clamp on an electrically grounded cabinet;

the dimensions of the wedge plate permitting an insulating jacket of a cable stripped from a the cable to be located between the sloped surface of a wedge plate and the sloped surface of the cavity to anchor the cable to the electrically grounded cabinet;

the flat bottom surfaces of the wedge plates in electrical contact with an exposed conductive layer of a cable.

2. A cable clamp as claimed in claim 1, further including longitudinal ribs on the sloped surface of said wedge members for gripping said jacket upon engagement of said mounting means.

3. A cable clamp as claimed in claim 1, wherein said mounting means comprises mounting screws for passage through the housing.

4. A cable clamp as claimed in claim 1, further including, ribs along the sloped surface of the cavity walls, for guiding the wedge plates into the housing.

5. A cable clamp as claimed in claim 1, wherein said exposed conductive layer extends through an aperture in the grounded cabinet to improve shielding.

6. A cable clamp as claimed in claim 3, further including support ears extending laterally from the bottom flat surface of the wedge plates, to support the grounded cabinet when the mounting screws are tightened.

* * * * *